US007377892B2

(12) United States Patent
Camossa et al.

(10) Patent No.: US 7,377,892 B2
(45) Date of Patent: May 27, 2008

(54) DEVICE FOR CONVEYING SIGNATURES BETWEEN TWO CYLINDERS OF A FOLDING MACHINE

(75) Inventors: Gino Camossa, Cossato (Biella) (IT); Riccardo Montagnini, Trino (Vercelli) (IT); Massimo Rolando, Ozzano Monferrato (Alessandria) (IT)

(73) Assignee: Officine Meccaniche G. Cerutti S.p.A., Casale Monferrato (al) (IT)

( * ) Notice: Subject to any disclaimer, the term of this patent is extended or adjusted under 35 U.S.C. 154(b) by 0 days.

(21) Appl. No.: 11/361,145

(22) Filed: Feb. 23, 2006

(65) Prior Publication Data

US 2007/0027013 A1 Feb. 1, 2007

(30) Foreign Application Priority Data

Jul. 29, 2005 (IT) ..... MI2005A1482

(51) Int. Cl.
*B31B 49/00* (2006.01)

(52) U.S. Cl. ..... 493/478; 493/432; 493/417

(58) Field of Classification Search ..... 493/478, 493/428, 432, 424, 417
See application file for complete search history.

(56) References Cited

U.S. PATENT DOCUMENTS 558,615 A * 4/1896 Saladee ..... 105/88
1,122,547 A * 12/1914 Spalckhaver ..... 493/428
1,979,093 A * 10/1934 Barber ..... 493/428
2,222,279 A * 11/1940 Barber ..... 270/32
2,659,437 A * 11/1953 Huck ..... 83/154
3,758,102 A * 9/1973 Munn et al. ..... 493/342
4,099,710 A * 7/1978 Boyer et al. ..... 493/420
4,344,610 A * 8/1982 Jeschke et al. ..... 270/6
4,494,949 A * 1/1985 Baley ..... 493/432
4,521,007 A * 6/1985 Darda ..... 270/47
4,817,932 A * 4/1989 Stab et al. ..... 270/47
4,842,574 A * 6/1989 Noble et al. ..... 493/421
5,226,871 A * 7/1993 Skipor ..... 493/425
5,547,452 A * 8/1996 Kepert et al. ..... 493/427
5,588,945 A * 12/1996 Lauderbaugh ..... 493/480
5,807,227 A * 9/1998 Field ..... 493/424
5,967,963 A * 10/1999 Gotting ..... 493/420
6,635,005 B1 * 10/2003 Duhamel et al. ..... 493/417
6,740,024 B2 * 5/2004 Kitai et al. ..... 493/428
6,902,519 B2 * 6/2005 Ochsner et al. ..... 493/428
6,994,662 B2 * 2/2006 Jornborn et al. ..... 493/56

* cited by examiner

*Primary Examiner*—Sameh H. Tawfik
(74) *Attorney, Agent, or Firm*—Darby & Darby

(57) ABSTRACT

A device for conveying signatures from a gripper cylinder to a folding cylinder comprises, in a free gap formed between the two cylinders, a supporting element supporting a plate which can be pivoted about a fulcrum, the plate rotatably supporting a signature guiding body having an oval cross-section and extending through the width of the cylinders, the body being covered, on a side thereof facing the cylinders, by a low friction web.

6 Claims, 3 Drawing Sheets

DEVICE FOR CONVEYING SIGNATURES BETWEEN TWO CYLINDERS OF A FOLDING MACHINE

BACKGROUND OF THE INVENTION

The present invention relates to a device for conveying signatures between the two cylinders of a signature folding machine.

As is known, a signature folding machine, supplied with signatures for example by a printing machine, comprises a rotary gripper cylinder in turn feeding the signatures, including several signature sheets, to a rotary folding cylinder.

In such a device, signatures are conveyed by a rotary gripper cylinder and delivered to a rotary signature folding cylinder, the grippers of which grip a signature along a central middle line thereof to fold said signature and convey the folded signature to further signature processing devices.

Also known is the fact that a critical region of the signature folding machine is constituted by the free region formed at the top of the machine between the gripper cylinder and folding machine since, in this region, the signature direction of movement is reversed.

To assure a satisfactory operation and a perfect reversal of the signature movement, it is necessary to provide in said region auxiliary devices, arranged between the two cylinders. Said guiding auxiliary devices are properly crowned, respectively curved, to fit the type of paper to be conveyed. Moreover, one must also consider the thickness of the signature forming material, the signature length and, most importantly, the number of sheets forming the signature.

Accordingly, for changing the mode of operation, in prior folding machine devices, it was absolutely necessary to stop the overall printing machine for a time sufficient to allow the guide device provided for a given type of signature to be replaced.

Moreover, it was necessary to store several guiding devices of the same type, to allow damaged or worn anti-friction coatings applied on prior guiding devices to be easily replaced.

SUMMARY OF THE INVENTION

Accordingly, the aim of the present invention is to overcome the above mentioned drawbacks, by providing, between a gripper cylinder and a folding cylinder, a single signature guiding device, for guiding signatures supplied from the gripper cylinder to the folding cylinder, to allow the device to be adjusted and to provide an instantaneous fitting to different processing requirements, without stopping the operation of the printing machine.

The above aim is achieved by a signature guiding device, arranged in a free gap formed between a signature feeding gripper cylinder and a signature folding and removing cylinder, by providing, in said free gap between said two cylinders, a supporting element supporting a pivoting plate which can be pivoted about a fulcrum, said plate rotatably supporting a signature guiding body having an oval cross-section and extending through the width of said cylinders, said guiding body having a cylinder facing side coated by a low friction web.

BRIEF DESCRIPTION OF THE DRAWINGS

The inventive subject matter will be disclosed in a more detailed manner hereinafter with reference to an exemplary embodiment thereof which is illustrated in the accompanying drawings, where.

DESCRIPTION OF THE PREFERRED EMBODIMENT

Figure 1:
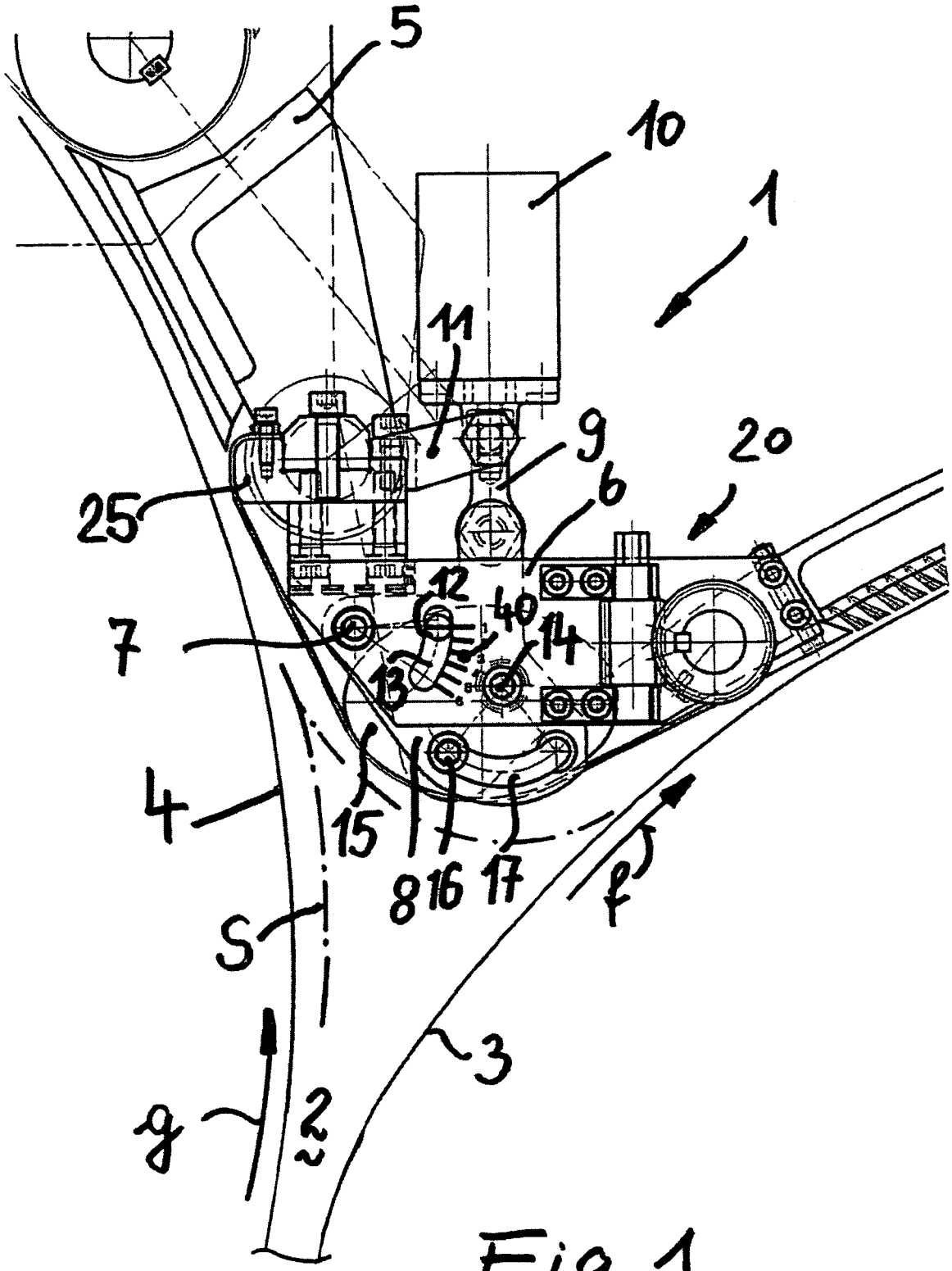
FIG. 1 schematically shows the device according to the present invention, the oval body thereof being arranged at a first position.

As shown in FIG. 1, the device according to the present invention, which has been generally indicated by the reference number 1, is arranged in a gap 2 defined between a gripper cylinder 3 and a folding cylinder 4.

The gripper cylinder 3 is driven in the direction shown by the arrow (f), whereas the folding cylinder 4 is driven in the direction shown by the arrow (g).

A locally fixed construction 5, included in the folding machine, bears a supporting element 6.

As shown, at both end portions of the cylinders 3 and 4, a supporting element 6, shown in FIG. 1 only at a side, is arranged.

The supporting element 6 supports, through a pivot pin 7, a plate 8, arranged beyond the supporting element 6 body, at a second arranging plane.

To the plate 8 is operatively coupled the rod 9 of a cylinder piston unit 10 in turn supported by a supporting arm 11 pertaining to the folding machine fixed construction 5.

From the plate 8 a flag pin 12, sliding in an elongate slot 13 formed in the supporting element 6 body, projects. The elongated slot 13 is provided with a graduated scale 40 to indicate the position of said pin and accordingly of the plate 8.

Through said plate 8 and supporting element 6 extends a screw 14 which supports, so as to swing or pivot about its horizontal axis, a contoured body 15 having an oval cross-section and extending through the overall width of the cylinders 3 and 4.

The oval cross-section body 15 comprises a locking screw 16 which, in an unlocked condition thereof, can be displaced within an elongated slot 17 formed through the plate 8.

Figure 2:
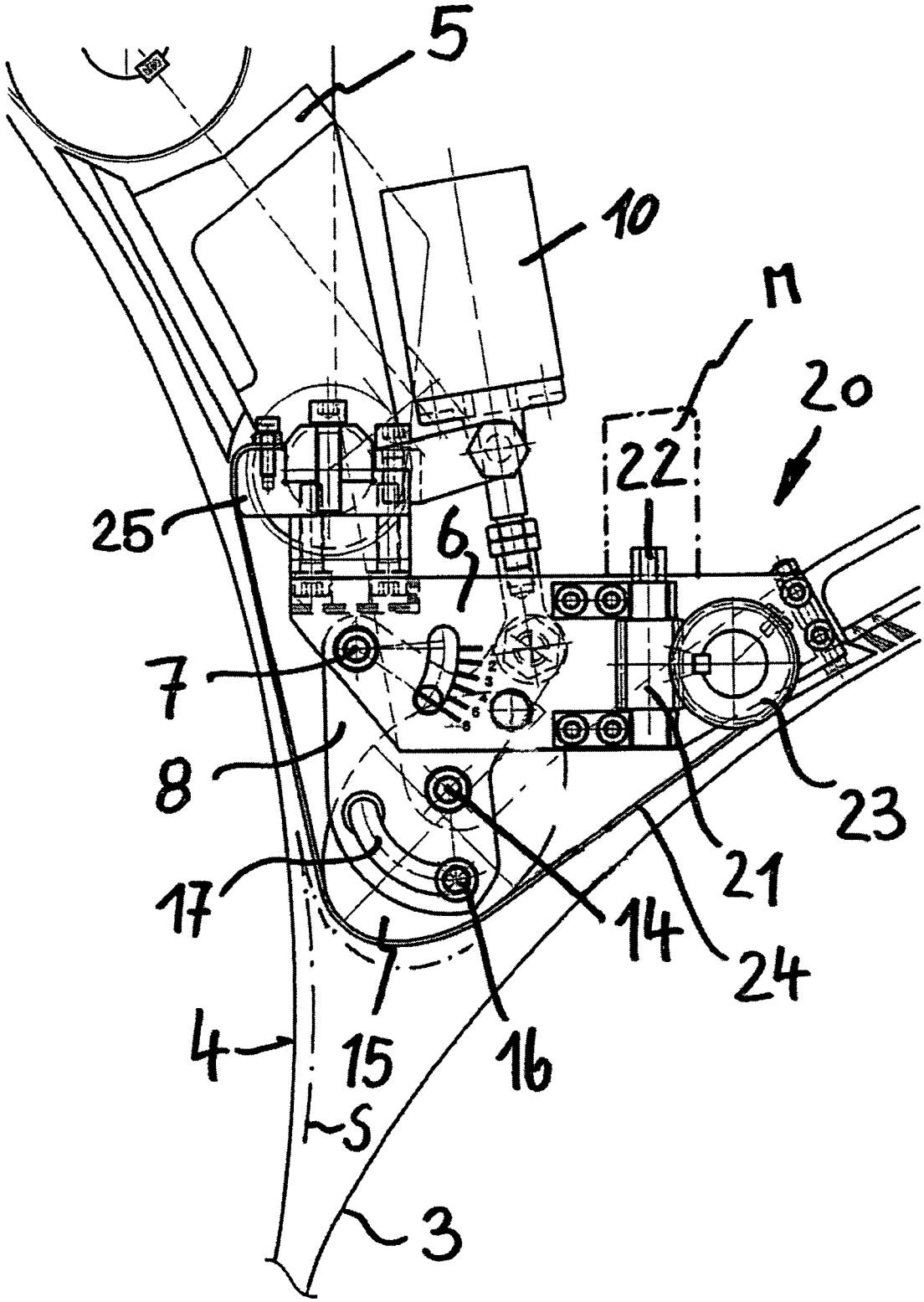
FIG. 2 shows the device of FIG. 1, the oval body thereof being arranged at a second position.

The supporting element 6 supports, on an outer side thereof, a screw-worm mechanism, generally indicated by the reference number 20 and which will be disclosed in a more detailed manner with reference to FIG. 2.

Said mechanism 20 comprises a worm screw 21 having a contoured end portion 22 for engaging therewith a driving wrench.

It would also be possible to drive the assembly through a controllable motor (M), advantageously a telecontrolled motor (M), to drive the means 21, 23 to a target position (see FIG. 2).

Said worm screw cooperates with a gear wheel 23 which, through a tube or drum-like body, is rigid with an end portion of a guiding web or belt 24 which partially encompasses the oval cross-section body 15, to extend toward a locking device 25 rigid with the structure or construction 5.

Since the operating length of the web or belt 24 will depend on the position assumed by the oval cross-section body 15, it should be self evident that, depending on said position of said oval cross-section body 15, the length of the web or belt 24 must be so adjusted to allow said web 24 to be shortened respectively increased in length, so as to always perfectly abut against the oval body, under a pressure provided by the cylinder-piston assembly 9, 10.

Thus, owing to the provision of said web or belt 24, it is possible to cover all recesses and unevennesses of the device 1 construction, to provide a continuous guide path for the signatures S coming from the gripper cylinder 3 and being delivered to and removed from the signature folding cylinder 4.

Advantageously, said web or belt 24 has a web surface with a very low friction, and accordingly it is possible to use a web coated by a Teflone® layer or any other anti-friction material.

Since the web or belt 24 is gradually worn to cause the antifriction coating thereof to be removed, it would be advantageous to connect an end portion of the web to the arm 25, while allowing the gear wheel 23 and related drum to receive a spare amount of web 24.

Thus, if a portion of the web is to be replaced, then it would be sufficient to unscrew the locking screw coupling the end portion of the web 24 to the arm 25 to unwind, for a set amount, the web from the spare drum, coupled with the gear wheel 23, and cut the worn web 24 and then fixing again the web to the arm 25.

Figure 3:
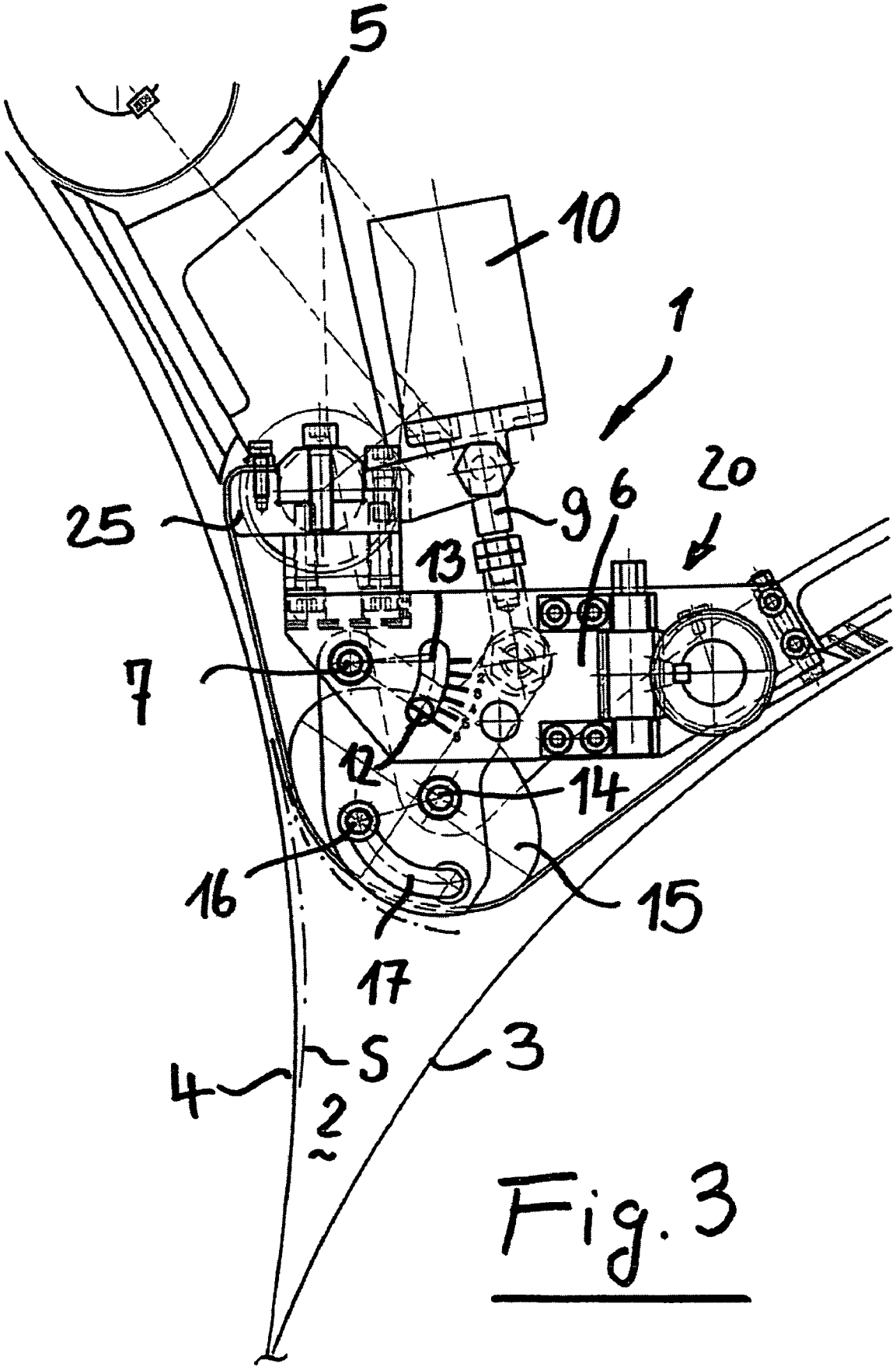
FIG. 3 shows the device of FIG. 1, the oval body thereof being arranged at a further position.

The device according to the present invention operates as follows:

By unthreading the screw 14 and screw 16 sliding in the elongated slot 17, it is possible to turn the oval cross-section body 15 about the screw 14, to allow said body to be adjusted or arranged as shown in FIGS. 1, 2 and 3, and this only by way of an example.

As the oval body is arranged in the gap 2 between the cylinders 3 and 4, it is of course necessary to fit the sliding web length 24, which can be achieved by operating the screw 21 and screw 23 to unwind a given amount of said guiding web 24.

To hold, after having adjusted the oval body 15, the web 24 in a suitably tensioned condition, the plate 8, pivotable to the fulcrum 7 will be pressed by the cylinder-piston unit 10 thereby continuously holding the oval body 15 in abutment against the web 24 to holding the latter in a tensioned condition, thereby providing an accurate path for the signatures.

The invention claimed is:

1. A signature guiding device arranged in a free gap formed between a signature feeding gripper cylinder and a signature removing and folding cylinder, characterized in that in said free gap between said two cylinders a supporting element is arranged, said supporting element supporting a pivotable plate which can be pivoted about a fulcrum, and that said pivotable plate rotatably supports a signature guiding body having an oval cross-section and extending through a width of said cylinders, said guiding body having a side thereof facing said cylinders and covered by a low friction web, wherein said supporting element supports an adjusting mechanism including a worm screw having a contoured end portion to be engaged by an operating wrench, that said worm screw drives a gear wheel which, by a tube or drum body, is rigid with an end portion of a guiding web partially encompassing said oval cross-section body and that an end portion of said guiding web is locked by a locking device rigid with the supporting construction.

2. A device according to claim 1, characterized in that said plate is operatively coupled to a rod of a cylinder-piston unit, said cylinder-piston unit being supported by a supporting arm included in a fixed construction of the folding machine.

3. A device according to claim 1, characterized in that from said plate a flag pin sliding through an elongated slot formed through said supporting element body projects.

4. A device according to claim 3, characterized in that said elongated slot receiving said flag pin is provided with a graduated scale.

5. A device according to claim 1, characterized in that said oval cross-section body comprises a locking screw which, in an unlocked condition thereof can be driven in an elongated slot formed through said plate.

6. A device according to claim 1, characterized in that said adjusting device is operatively coupled to a telecontrolled motor.

* * * * *